US007424794B2

(12) United States Patent
Baranowski

(10) Patent No.: US 7,424,794 B2
(45) Date of Patent: Sep. 16, 2008

(54) WOOD BOARD FLOOR ON EXTERNAL TERRACES

(76) Inventor: Grzegorz Baranowski, ul. Abrahana 48, 80 307 Gdansk-Oliwa (PL)

( * ) Notice: Subject to any disclaimer, the term of this patent is extended or adjusted under 35 U.S.C. 154(b) by 0 days.

(21) Appl. No.: 10/433,862

(22) PCT Filed: Dec. 3, 2001

(86) PCT No.: PCT/PL01/00096

§ 371 (c)(1),
(2), (4) Date: Jun. 4, 2003

(87) PCT Pub. No.: WO02/046546

PCT Pub. Date: Jul. 13, 2002

(65) Prior Publication Data

US 2004/0040238 A1 Mar. 4, 2004

(30) Foreign Application Priority Data

Dec. 4, 2000 (PL) ..... 344316

(51) Int. Cl.
*E04B 2/30* (2006.01)

(52) U.S. Cl. ..... 52/483.1; 52/480; 52/302.1; 52/650.3

(58) Field of Classification Search ..... 52/483.1, 52/58, 97, 177, 716.2, 302.1, 302.2, 480, 52/650.3
See application file for complete search history.

(56) References Cited

U.S. PATENT DOCUMENTS 3,760,541 A * 9/1973 Fulcher ..... 52/203
4,742,654 A * 5/1988 Cole ..... 52/97
4,848,049 A * 7/1989 Hanson ..... 52/97
4,858,399 A * 8/1989 Salato, Jr. ..... 52/97
4,885,882 A * 12/1989 Forshee ..... 52/177
4,907,387 A * 3/1990 Turnbull ..... 52/177
5,148,644 A 9/1992 Weir
5,280,692 A * 1/1994 Patey ..... 52/716.2
5,474,831 A * 12/1995 Nystrom ..... 428/174
6,108,992 A * 8/2000 Shaw ..... 52/302.3
6,131,355 A * 10/2000 Groh et al. ..... 52/592.1
6,385,931 B1 * 5/2002 Risser ..... 52/302.1
6,415,571 B2 * 7/2002 Risser ..... 52/302.1
6,449,911 B1 * 9/2002 Hudson ..... 52/58
6,505,449 B1 * 1/2003 Gregori ..... 52/514
6,796,092 B1 * 9/2004 Goebel ..... 52/302.1
6,804,923 B1 * 10/2004 Potter ..... 52/480

FOREIGN PATENT DOCUMENTS

DE 44 43 712 A1 6/1996
WO WO 94/01632 1/1994

* cited by examiner

*Primary Examiner*—Basil Katcheves
(74) *Attorney, Agent, or Firm*—Horst M. Kasper

(57) ABSTRACT

The floor according to the invention consists of boards (1), especially wood boards laid on joists (2) and secured to them by fasteners (3) or adhesive and is designed for the use on the unroofed area, external terraces, platforms and jetties or in rooms where water may run out on the floor, while the board (1) of the floor along its bottom edge has the water drip (4), and located between the board (1) of the floor and the joist (2) is the distance piece to mover away the bottom surface of the board (1) of the floor from the top surface of the joist fragment passing especially under the water drip (4). Moreover, the board (1) is secured to one joist (2) by three fasteners (3).

12 Claims, 6 Drawing Sheets

E - E

F - F

G - G

H - H

WOOD BOARD FLOOR ON EXTERNAL TERRACES

FIELD OF THE INVENTION

The object of this invention is the floor consisting of boards especially wood boards, laid on joists and secured to them by fasteners or adhesive. The joists are made of corrosion-resistant metal or frost-resistant and waterproof plastics or wood and are usually flat laid on structural elements. The floor is designed for the use on the unroofed area, external terraces, platforms and jetties or in rooms where water may run out on the floor.

Description of the related art including information disclosed under 37 CFR 1.97 and 1.98.

At the existing stage of technology floors exposed to the influence of water, in particular, precipitations consist of wood boards laid in parallel in row with small slots between the boards. Boards are usually flat laid on joists perpendicular to them, are secured to the joists by nails or screws. Boards of such floor are not provided with a groove and tongue in side planes, and usually have a transverse square section. The doors adjoin the joist over the entire contact surface of these elements, i.e. over the entire surface of the quadrangle determined with intersecting bottom board edges and top joist edges. The disadvantage of these solutions is that water may leak over the bottom surface while flowing down from the top surface usually over the vertical side surfaces of the boards. This water or water of coming from the rolling waves that flood the boards from underneath easily penetrates the slots of the joint between the floor and the joist. From the narrow space of the slot of this joint, water practically has no possibility to drain or evaporate. The water entrapped in the slot of the joint between the board and the joist causes the wood to rot and moulder. It is impossible to restore the wood protection, inter alia, against the destructive water influence in the place of the joint between the board and joist, without removal of the floor or in view of the fact that the destructions are already caused to the wood. Dismantling of the floor for preservation is, however, difficult or unprofitable or often impossible.

Any restoration of protection for other fragments of the bottom board surface is also burdensome if they are inaccessible from underneath. An access to these fragments through the slot between the boards is additionally made difficult by restriction of the execution of protection only on the lengths between the joists and not over the whole length of the board. The top and side surfaces of floor board are subject to periodical influence of water, precipitations and rough waves. After some time water flows down from these surfaces, evaporates or is removed. Periodical water influence on the exposed parts of the floor board is relatively not dangerous provided that they are effectively protected against the destructive water influence before the floor is assembled. Boards, usually at some time intervals, are painted with wood-preserving agent. The top board surface is usually painted. It is also possible to protect the side edges using narrow painting tools movable in the slot between the boards. Any impurities (e.g. sand, leaves, animal's hair) are accumulated on the fragment of the top joist surface because they fall through the vertical slot between the boards. If the impurities are not regularly removed the layers of same will build up. The impurities soak in water that in this place dries with difficulty and wet impurities with time begin to fill the slot between the boards. The surface where these wet impurities adjoin the floor board is another place exposed to the accelerated wood rotting and decay.

Water when entrapped in closed slots between the joints of floor elements, difficulties in preservation of some board surfaces and the unfavorable influence of accumulated wet impurities cause the floor wood board to be relatively quickly destroyed.

BRIEF SUMMARY OF THE INVENTION

The essence of the solution according to the invention is the floor structure consisting of boards especially wood boards, laid on joists and secured to them by fasteners, e.g. nails, screws or adhesive. The floor is designed for the use on the unroofed area, external terraces, platforms and jetties or in rooms where water may run out on the floor. The floor board (1) along its bottom edges has a water drip, while the distance piece is arranged between the floor board and the joist in order to move away the water drip (4) from the top surface of the joist fragment passing under the water drip.

The floor in the solution according to the invention allows achieving an unexpected effect consisting in that precipitation water is prevented from the ingress into the joint slot between the bottom board surface and the top surface of the joist of element that adjoins the board. The joint slot of these elements remains in the air-dry condition. Owing to the lack of moisture entrapped in the said slot the wood not to be subject to rottening and decay, thereby, the life of the floor will substantially be extended. Thus, the wood preservation restoration on the surface of the said joint has not to be carried out for the reason that water is not entrapped there. The use of the water drip determines the control of the place where water drops drip, i.e. from the lowermost point.

It is possible to restore from the top the protection for not large fragment of the bottom surface of the board over its whole length along the water drip using a specialist tool that may be moved in the slot between the boards over the whole board length. In addition, impurities that are accumulated on the top surface of the joist under the slot and between the boards if even they are not regularly removed and soak water, in the solution according to the invention, do not cause the wood board to rot or moulder. This is obtained owing to the increase of the distance between the surface where the impurities are accumulated and the bottom surface of the protected board, thereby, they not touch the board. Moreover, the use of the water drip as the groove along the bottom board edges will decrease the possibility of floor board warping caused by moisture soaking of the bottom parts of boards that are not dried by sun rays.

As the boards are secured to the joist by three fasteners it is possible to use smaller pads between the board and joist. It causes the board contact surface adjoining the board supporting elements to be decreased, thereby, the board surface maintainable in air-day condition to be increased. In particular, it is important in the event that there is a risk of floor flooding with water from underneath, e.g. on platforms and jetties by rough waves. Three fasteners determine and provide the maintaining of straight and unchanged board surface which under the influence of variable atmospheric factors and flooding with water has a tendency to warping.

The above favourable effects of the solution according to the invention considerably extend the service life of the floor as compared with the life of the floor made according to the existing solutions.

BRIEF DESCRIPTION OF SEVERAL VIEWS OF THE DRAWINGS

The object of the invention is diagrammatically shown on the figure where.

DETAILED DESCRIPTION OF THE INVENTION

Figure 1:
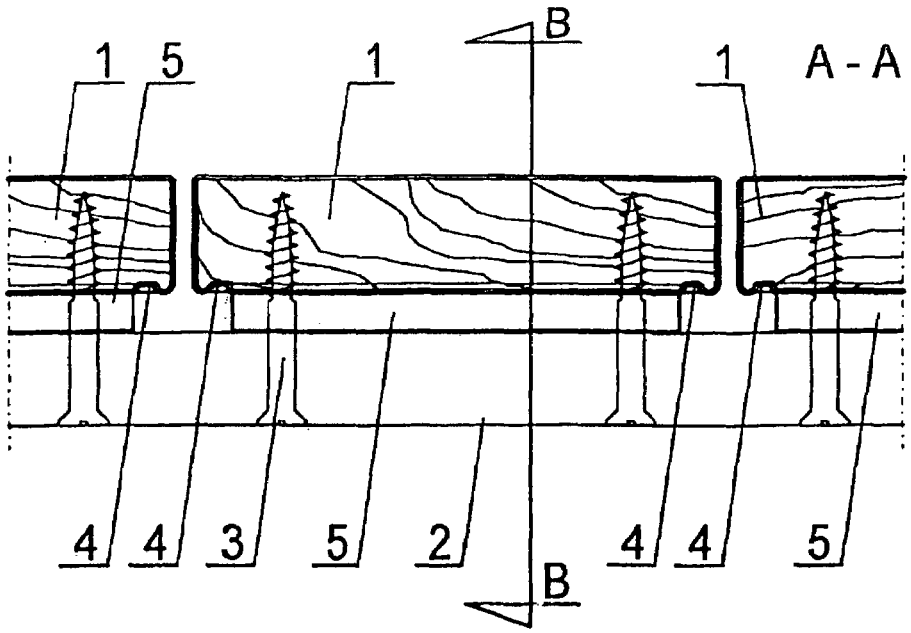
FIG. 1 shows the fragment of vertical section A-A, perpendicular to the longer floor board edges in the first example of floor make; the floor board is secured to the joists by fasteners and the board has a water drip, while the pad to move away water drip (4) from the top surface of the joist is located between the board and the joist.
Figure 2:
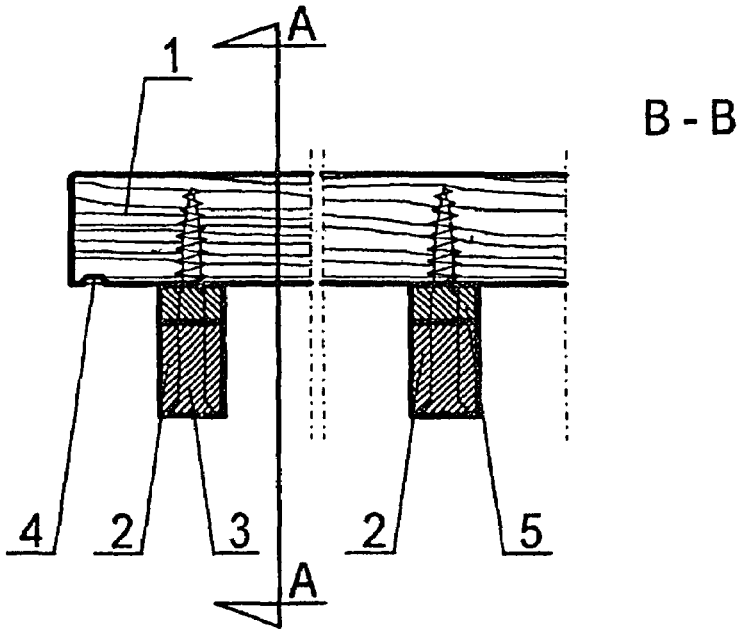
FIG. 2 shows the fragment of vertical section B-B, parallel to the longer floor board edges in the first example of the board make; the floor board is secured to the joists by fasteners and the board has a water drip, while the pad to move away water drip (4) from the top surface of the joist is located between the board and the joist.

In the first example of the floor make shown in FIG. 1 and FIG. 2 the floor according to the invention consists of boards (1) laid on the joist (2) and secured to it by fasteners (3). The board (1) along its bottom edges has the water drip (4). The water drip (4) is provided with a milled longitudinal profile. The fragment of the vertical section of the water drip profile passes from bottom to the top, in the direction of water leaking to the centre of the bottom board surface. It causes the water drops to drip down from the lowermost water drip position. Located between the board (1) and the joist (2) is the distance piece to move away the water drip (4) from the top surface of the joist fragment passing under the water drip (4), i.e. in this example of the make—pad (5).

Figure 3:
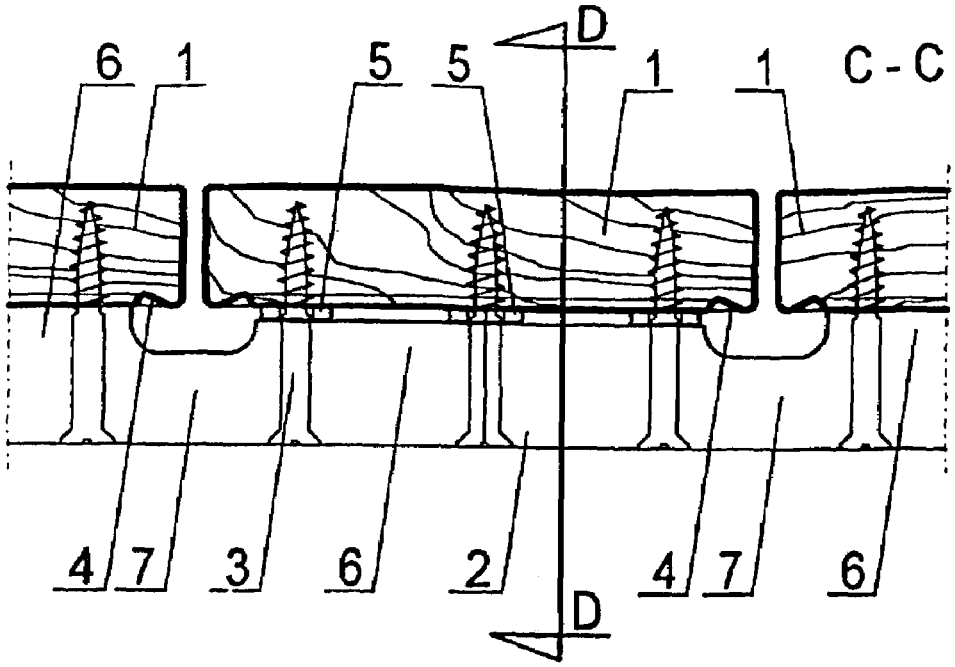
FIG. 3 shows the fragment of vertical section C-C, perpendicular to the longer floor board edges in the second example of floor make; the floor board is secured to the joists by fasteners and the board has a water drip, while a suitably profiled fragment of the joist passing between the water drips of the longer sides of one board has a greater height than the fragment of the joist passing under the water drip; in the first version of this example relating to the centre board of this figure, the floor has additionally also pads and is secured to the joists by three fasteners.
Figure 4:
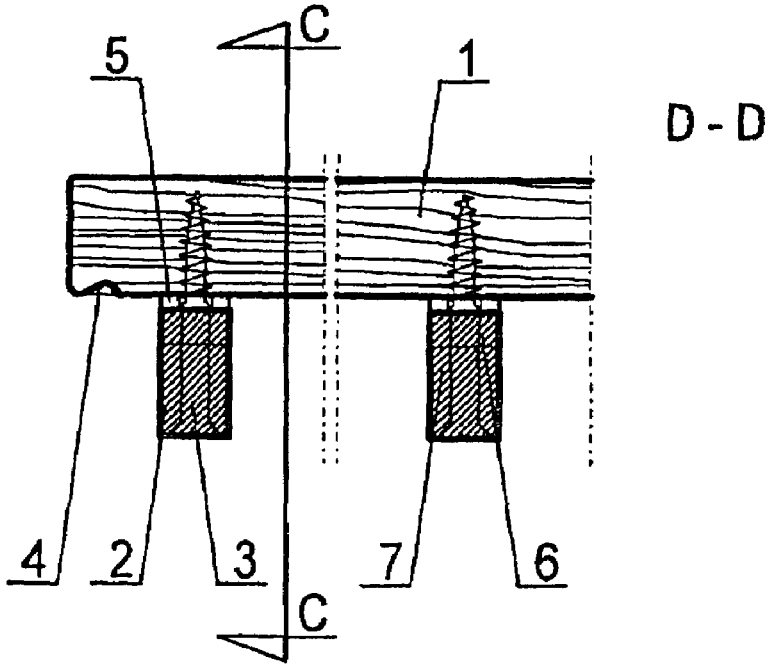
FIG. 4 shows the fragment of vertical section D-D, parallel to the longer floor board edges in the second example of the floor make; the floor board is secured to the joists by fasteners and the board has a water drip, while a suitably profiled segment of the joist passing between the water drips of the longer sides of one board has a greater height than the fragment of the joist passing under the water drip; in the version of this example relating to the centre board of FIG. 3, the floor has additionally also pads and is secured to the joists by three fasteners.
Figure 5:
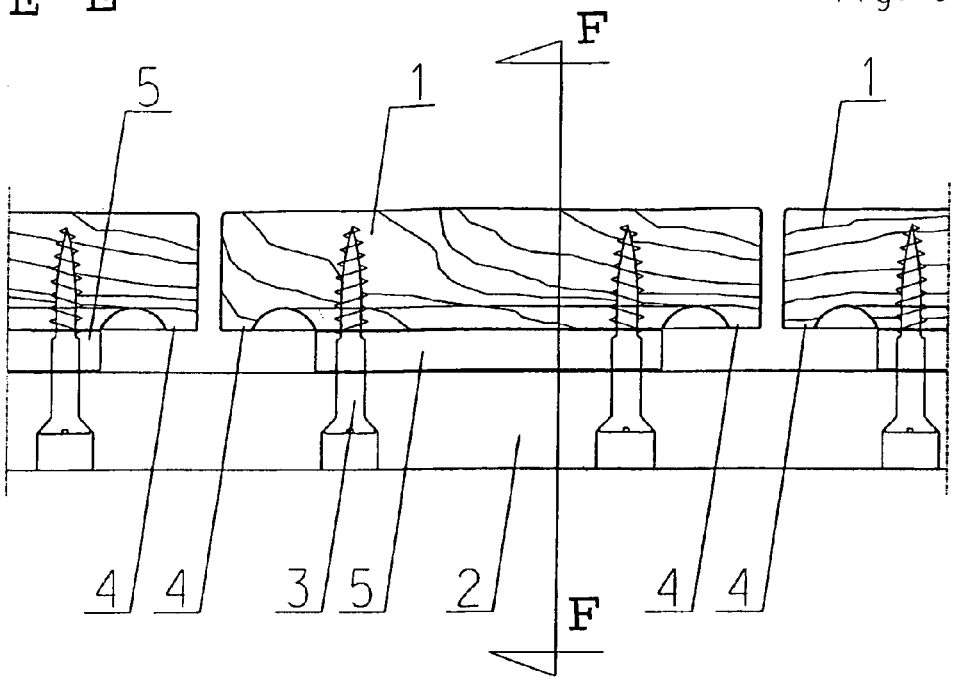
FIG. 5 shows the fragment of vertical section E-E, perpendicular to the longer floor board edges in the first example of floor make.
Figure 6:
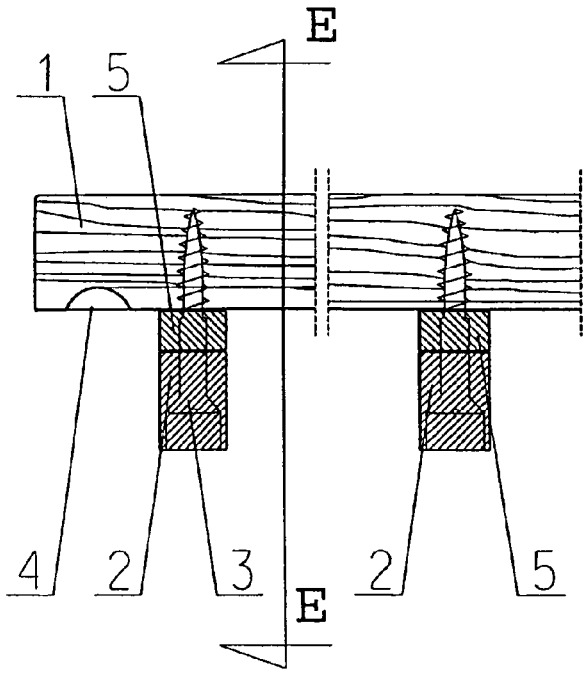
FIG. 6 shows the fragment of vertical section F-F, parallel to the longer floor board edges in the first example of floor make.
Figure 7:
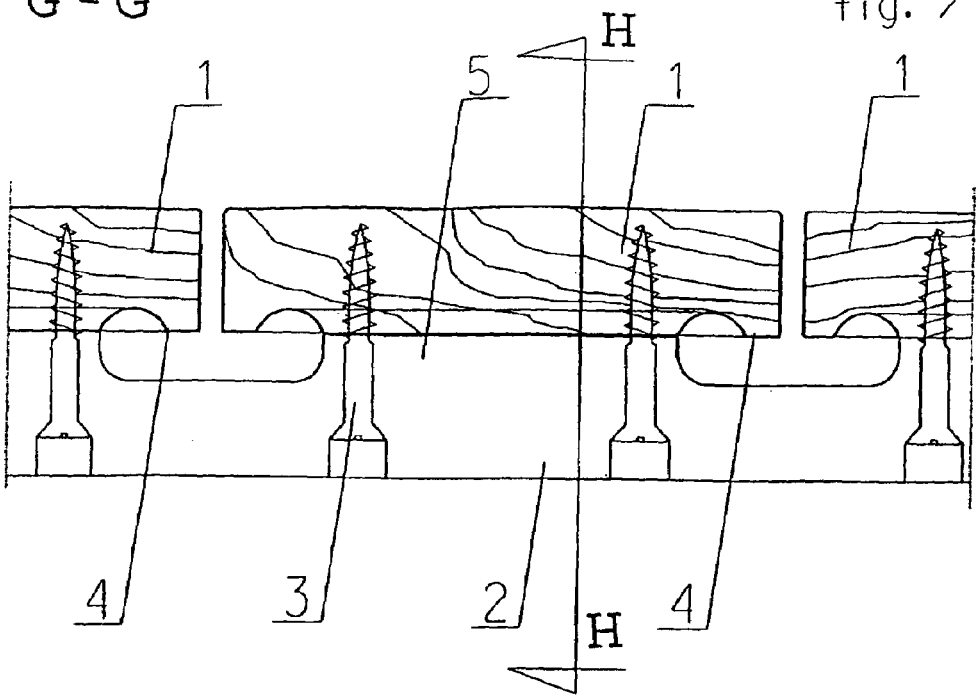
FIG. 7 shows the fragment of vertical section G-G, perpendicular to the longer floor board edges in the second example of floor make.
Figure 8:
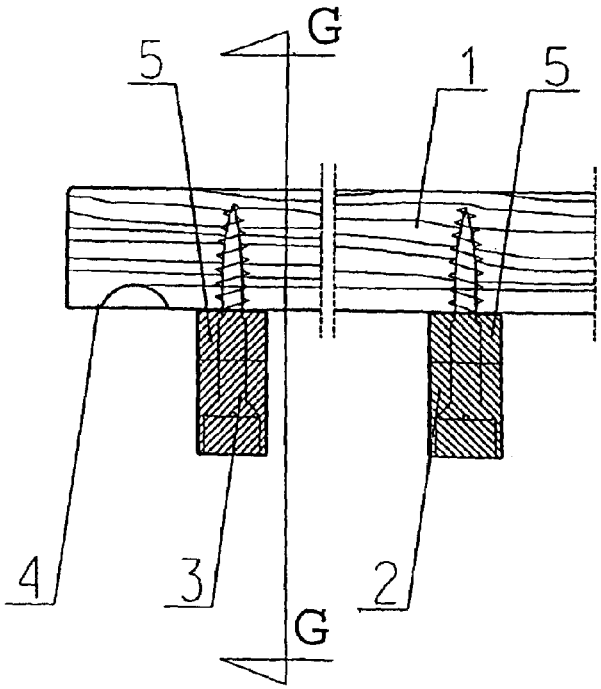
FIG. 8 shows the fragment of vertical section H-H, parallel to the longer floor board edges in the second example of the floor make.
Figure 9:
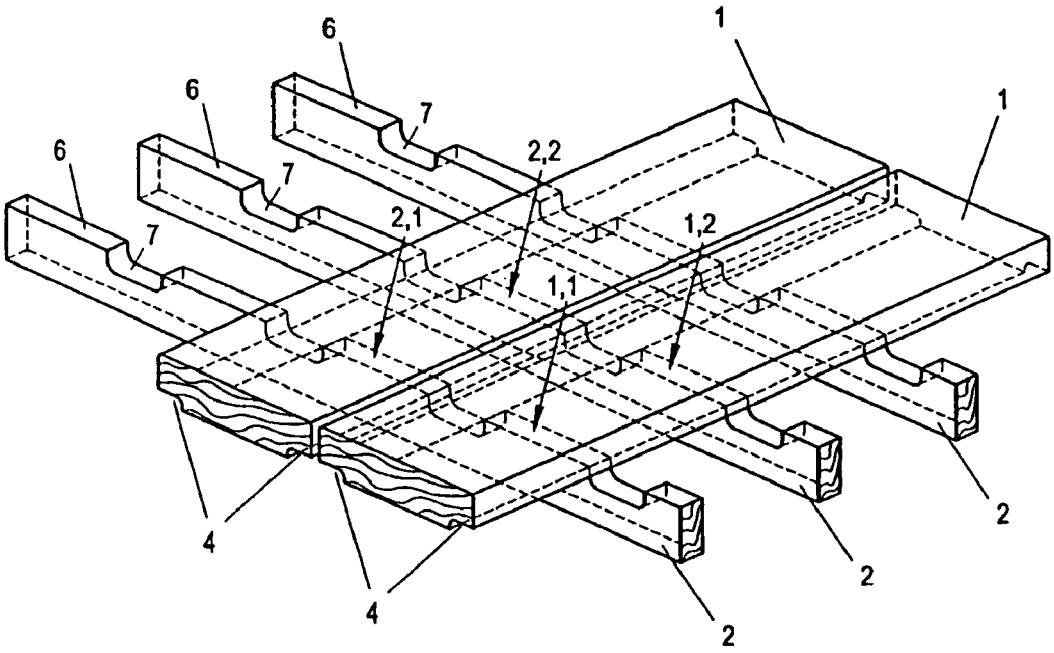
FIG. 9 shows a perspective view of an assembly of two neighboring boards.
Figure 10:
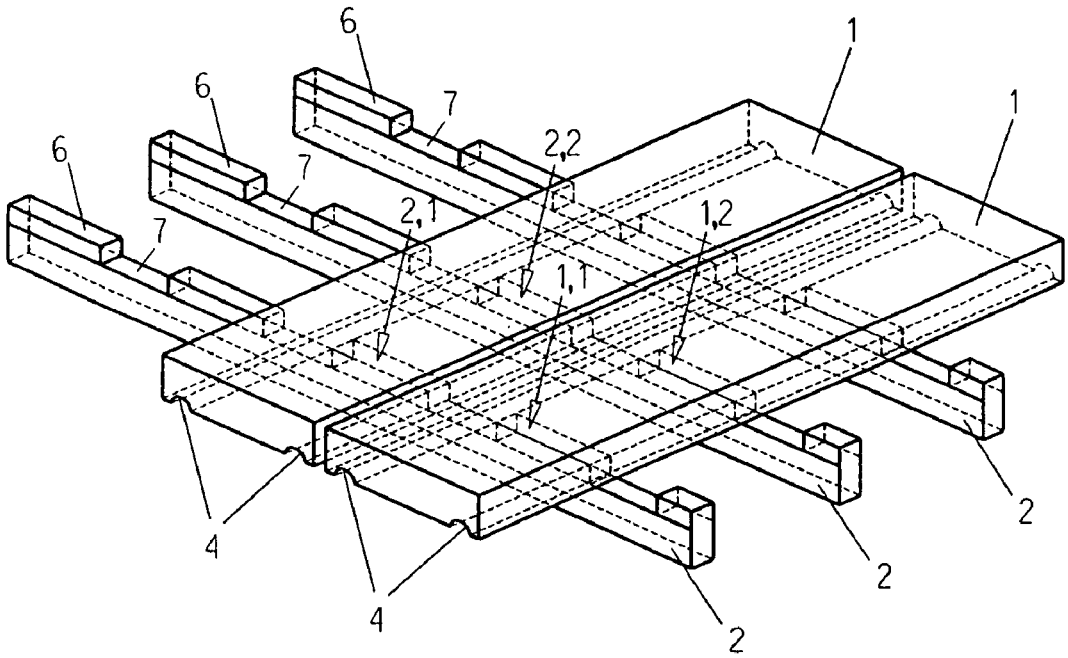
FIG. 10 shows a perspective view, similar to FIG. 9, of an assembly of two neighboring boards.

In the second example of the floor make shown in FIG. 3 and FIG. 4 the floor according to the invention consists of boards (1) laid on the joist (2) and secured to it by fasteners (3). The board (1) along its bottom edges has the water drip (4). The water drip (4) is provided with a milled longitudinal profile. Located between the board (1) and the joist (2) is the distance piece to move away the water drip (4) from the top surface of the joist fragment passing especially under the water drip (4). In this example of the make is a suitably profiled fragment (6) of the joist that passes between the joists (4) of the same board and has height than the fragment (7) that passes under the water drip (4). In this version of the example relating to the centre board according to FIG. 3, the floor is additionally provided with the pad (5), and the board is secured to the joists by three fasteners (3).

The invention claimed is:

1. A floor comprising a plurality of joists (2) having a top surface;

a plurality of boards (1), wherein the plurality of boards is laid on the plurality of joists (2) and forms a floor;

a plurality of fasteners (3), wherein the plurality of boards is secured to the plurality of joists (2) by the plurality of fasteners (3); wherein a board (1) of the plurality of boards has a longitudinal bottom edge;

a water drip (4) disposed along the longitudinal bottom edge of the board (1) and forming an integral part of the board (1);

a distance piece located between the board (1) of the floor and the plurality of joists (2), wherein the distance piece (5) separates the water drip (4), from the top surface of the plurality of joists passing through under the water drip (4);

wherein the water drip (4) is furnished with a milled longitudinal profile;

wherein the board is secured to one of the plurality of joists by three fasteners;

wherein the plurality of boards comprises boards made out of wood;

wherein each one of the plurality of boards exhibits a first longitudinal recess on the bottom side of each board near a neighboring first longitudinal edge of the board for forming a respective first water drip (4);

wherein each of the plurality of boards exhibits a second longitudinal recess on the bottom side of each board near a neighboring second longitudinal edge of the board for forming a respective second water drip (4);

wherein the distance piece (5) has a length which is no more than the distance of the first longitudinal recess from the second longitudinal recess;

wherein the distance piece (5) has a width which is substantially equal to a width of the plurality of joists (2) and wherein the distance piece is disposed between one of the plurality of boards and one of the plurality of joists at the intersection of the respective board and joist when seen in projection;

wherein the first longitudinal recess has the shape of a cylinder section, wherein the second longitudinal recess has the shape of the cylinder section, wherein the distance piece (5) has a thickness which is no more than the width of the cylinder section;

wherein the plurality of boards are disposed parallel to each other and are disposed in a first common plane, wherein the plurality of joists are disposed parallel to each other and are disposed in a second common plane, wherein the first common plane is disposed parallel to the second common plane, wherein the plurality of boards have a longitudinal extension, wherein the longitudinal extension of the boards is disposed perpendicular to a longitudinal extension of the plurality of joists;

wherein the plurality of boards are disposed at a predetermined distance from each other and each one of the plurality of boards has substantially a rectangular cross section.

2. The floor according to claim 1 wherein the water drip forms an undivided solid single piece together with the board (1).

3. The floor according to claim 1, wherein the water drip (4) is disposed on a bottom side of the board and wherein a structure of the water drip (4) does not extend more than one fifth of a width of the board from the longitudinal bottom edge of the board along an underside of the board.

4. A floor comprising a plurality of joists (2) having a top surface;

a plurality of boards (1), wherein the plurality of boards is laid on the plurality of joists (2) and forms a floor;

a plurality of fasteners (3), wherein the plurality of boards is secured to the plurality of joists (2) by the plurality of fasteners (3); wherein a board (1) of the plurality of boards has a longitudinal bottom edge;

a water drip (4) disposed along the longitudinal bottom edge of the board (1) and forming an integral part of the board (1);

a distance piece located between the board (1) of the floor and the plurality of joists (2), wherein the distance piece (5) separates the water drip (4), from the top surface of the plurality of joists passing through under the water drip (4);

wherein the water drip (4) is furnished with a milled longitudinal profile;

wherein the board is secured to one of the plurality of joists by fasteners;

wherein the plurality of boards comprises boards made out of wood;

wherein each one of the plurality of boards exhibits a first longitudinal recess on the bottom side of each board near a neighboring first longitudinal edge of the board for forming a respective first water drip (4);

wherein each one of the plurality of boards exhibits a second longitudinal recess on the bottom side of each board near a neighboring second longitudinal edge of the board for forming a respective second water drip (4);

wherein the distance piece (5) has a length which is no more than the distance of the first longitudinal recess from the second longitudinal recess;

wherein the distance piece (5) has a width which is substantially equal to a width of the plurality of joists (2) and wherein the distance piece is disposed between one of the plurality of boards and one of the plurality of joists at the intersection of the respective board and joist when seen in projection;

wherein the first longitudinal recess has the shape of a cylinder section, wherein the second longitudinal recess has the shape of the cylinder section, wherein the distance piece (5) has a thickness which is no more than the width of the cylinder section;

wherein the plurality of boards are disposed substantially parallel to each other and are disposed in a first common plane, wherein the plurality of joists are disposed parallel to each other and are disposed in a second common plane, wherein the first common plane is disposed parallel to the second common plane, wherein the plurality of boards have a longitudinal extension, wherein the longitudinal extension of the boards is disposed substantially perpendicular to a longitudinal extension of the plurality of joists;

wherein the plurality of boards are disposed at a predetermined distance from each other and each one of the plurality of boards has substantially a rectangular cross section.

5. The floor according to claim 4 wherein the water drip (4) forms an undivided solid single piece together with the board (1).

6. The floor according to claim 4, wherein the water drip (4) is disposed on a bottom side of the board and wherein a structure of the water drip (4) does not extend more than one fifth of a width of the board from the longitudinal bottom edge of the board along an underside of the board.

7. A floor comprising a plurality of joists (2) having a top surface;

a plurality of boards (1), wherein the plurality of boards is laid on the plurality of joists (2) and forms a floor;

a plurality of fasteners (3), wherein the plurality of boards is secured to the plurality of joists (2) by the plurality of fasteners (3); wherein a board (1) of the plurality of boards has a longitudinal bottom edge;

a water drip (4) disposed along the longitudinal bottom edge of the board (1) and forming an integral part of the board (1);

a distance piece located between the board (1) of the floor and the plurality of joists (2), wherein the distance piece (5) separates the water drip (4), from the top surface of the plurality of joists passing through under the water drip (4);

wherein the water drip (4) is furnished with a milled longitudinal profile;

wherein the board is secured to one of the plurality of joists by three fasteners;

wherein the plurality of boards comprises boards made out of wood;

wherein each one of the plurality of boards exhibits a first longitudinal recess on the bottom side of each board near a neighboring first longitudinal edge of the board for forming a respective first water drip (4);

wherein each one of the plurality of boards exhibits a second longitudinal recess on the bottom side of each board near a neighboring second longitudinal edge of the board for forming a respective second water drip (4);

wherein the distance piece (5) has a length which is no more than the distance of the first longitudinal recess from the second longitudinal recess;

wherein the distance piece (5) has a width which is substantially equal to a width of the plurality of joists (2) and wherein the distance piece is disposed between one of the plurality of boards and one of the plurality of joists at the intersection of the respective board and joist when seen in projection;

wherein the first longitudinal recess has the shape of a cylinder section, wherein the second longitudinal recess has the shape of the cylinder section, wherein the plurality of boards are disposed parallel to each other and are disposed in a first common plane, wherein the plurality of joists are disposed parallel to each other and are disposed in a second common plane, wherein the first common plane is disposed parallel to the second common plane, wherein the plurality of boards have a longitudinal extension, wherein the longitudinal extension of the boards is disposed perpendicular to a longitudinal extension of the plurality of joists;

wherein the plurality of boards are disposed at a predetermined distance from each other and each one of the plurality of boards has substantially a rectangular cross section.

8. The floor according to claim 7 wherein the water drip (4) forms an undivided solid single piece together with the board (1).

9. The floor according to claim 7, wherein the water drip (4) is disposed on a bottom side of the board and wherein a structure of the water drip (4) does not extend more than one fifth of a width of the board from the longitudinal bottom edge of the board along an underside of the board.

10. A floor comprising a plurality of joists (2) having a top surface;

a plurality of boards (1), wherein the plurality of boards is laid on the plurality of joists (2) and forms a floor;

a plurality of fasteners (3), wherein the plurality of boards is secured to the plurality of joists (2) by the plurality of fasteners (3); wherein a board (1) of the plurality of boards has a longitudinal bottom edge;

a water drip (4) disposed along the longitudinal bottom edge of the board (1) and forming an integral part of the board (1);

a distance piece located between the board (1) of the floor and the plurality of joists (2), wherein the distance piece (5) separates the water drip (4), from the top surface of the plurality of joists passing through under the water drip (4);

wherein the water drip (4) is furnished with a milled longitudinal profile;

wherein the board is secured to one of the plurality of joists by fasteners;

wherein the plurality of boards comprises boards made out of wood;

wherein each one of the plurality of boards exhibits a first longitudinal recess on the bottom side of each board near a neighboring first longitudinal edge of the board for forming a respective first water drip (4);

wherein each one of the plurality of boards exhibits a second longitudinal recess on the bottom side of each board near a neighboring second longitudinal edge of the board for forming a respective second water drip (4);

wherein the distance piece (5) has a length which is no more than the distance of the first longitudinal recess from the second longitudinal recess;

wherein the distance piece (5) has a width which is substantially equal to a width of the plurality of joists (2) and wherein the distance piece is disposed between one of the plurality of boards and one of the plurality of joists at the intersection of the respective board and joist when seen in projection;

wherein the first longitudinal recess has the shape of a cylinder section, wherein the second longitudinal recess has the shape of the cylinder section, wherein the plurality of boards are disposed substantially parallel to each other and are disposed in a first common plane, wherein the plurality of joists are disposed parallel to each other and are disposed in a second common plane, wherein the first common plane is disposed parallel to the second common plane, wherein the plurality of boards have a longitudinal extension, wherein the longitudinal extension of the boards is disposed substantially perpendicular to a longitudinal extension of the plurality of joists;

wherein the plurality of boards are disposed at a predetermined distance from each other and each one of the plurality of boards has substantially a rectangular cross section.

11. The floor according to claim 10 wherein the water drip (4) forms an undivided solid single piece together with the board (1).

12. The floor according to claim 10, wherein the water drip (4) is disposed on a bottom side of the board and wherein a structure of the water drip (4) does not extend more than one fifth of a width of the board from the longitudinal bottom edge of the board along an underside of the board.

* * * * *